United States Patent [19]

Hutchings

[11] 4,113,256

[45] Sep. 12, 1978

[54] DUAL NATURE PUZZLE PIECES

[76] Inventor: David Roy Hutchings, R.R. 3, Box 149 S, Leander, Tex. 78641

[21] Appl. No.: 802,253

[22] Filed: May 31, 1977

[51] Int. Cl.[2] ..... A63F 9/12

[52] U.S. Cl. ..... 273/160; 35/72

[58] Field of Search ..... 273/156, 157 R, 160; 35/72; 46/25

[56] References Cited

U.S. PATENT DOCUMENTS 3,885,794 5/1975 Coffin ..... 273/160

FOREIGN PATENT DOCUMENTS 245,402 7/1947 Switzerland ..... 273/160

*Primary Examiner*—Anton O. Oechsle

[57] ABSTRACT

Two three-dimensional shapes are described. The shapes may be used together both for the working of space-relational puzzles and for the working of many and various tile-like designs.

2 Claims, 9 Drawing Figures

DUAL NATURE PUZZLE PIECES

BACKGROUND AND SUMMARY

This invention relates to puzzle pieces which have either a nature to tile non-periodic geometric designs against a flat surface or to spatially interrelate as an integrated and coherent three-dimensional structure.

The simpler of the piece shapes comprises and conforms closely to a polyhedron having six surfaces, one of which surfaces is a concave polygon of five equal sides. Each of the other five surfaces borders a different one of the five sides and together make five dihedral angles with the polygon. Four of these dihedrals measure about 63 degrees each. The fifth is about half of that measure and is located opposite the two divergent sides of the polygon.

The other piece shape is in ways similar to the first and conforms closely to a lengthier polyhedron of two more surfaces than the earlier polyhedron. The six surfaces described for that earlier polyhedron are represented in the second polyhedron, more or less preserving all angular relationships. The second polyhedron does differ though in that the surfaces which preserve the corresponding fifth dihedral angle are, by comparison, expanded lengthwise and extended widthwise at midsections while the two surfaces corresponding opposite of this angle are seen to be non-adjacent to include between them instead the seventh and eighth surfaces, these latter four surfaces making, furthermore, parallel pairs of surfaces.

DESCRIPTION OF THE DRAWINGS

The invention will be understood more fully from the following description, with reference to the accompanying drawings wherein.

Figure 4:
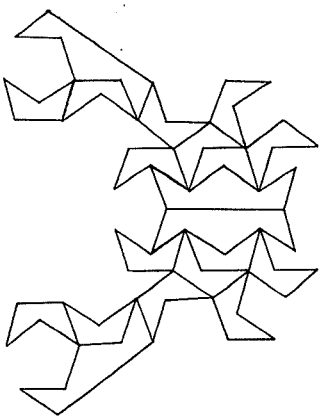
Figure 5:
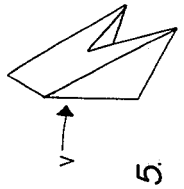
Figure 2A:
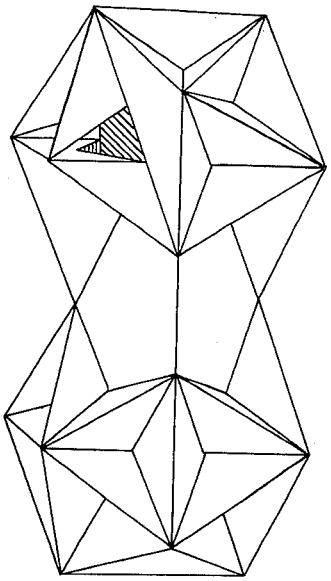
Figure 2A:
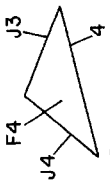
Figure 2B:
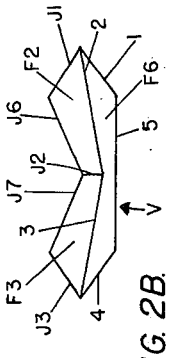
Figure 2C:
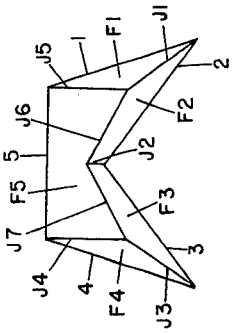

FIGS. *2a–c* illustrate the shape of the simpler piece, with FIG. *2a* an end view, FIG. *2b* a rotated view, FIG. *2c* a plan view of the shape;

FIGS. *3a–c* illustrate the shape of the second piece, using similar type views as were used in FIGS. *2a–c*;

FIG. 4 illustrates a geometric design which can be duplicated by the puzzle pieces;

FIG. 5 illustrates a three-dimensional puzzle which can be assembled also using the puzzle pieces.

DESCRIPTION OF THE PREFERRED EMBODIMENT

Figure 1:
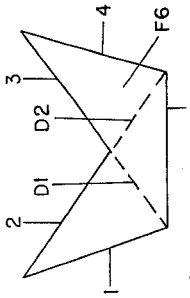
FIG. 1 illustrates the geometry of the larger, or bottom, surface of the simpler piece shape.
Figure 3A:
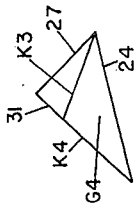
Figure 3B:
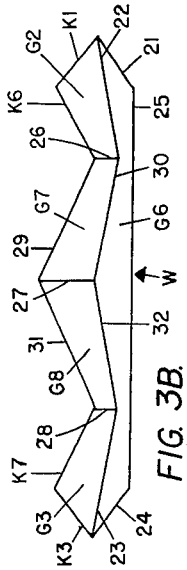
Figure 3C:
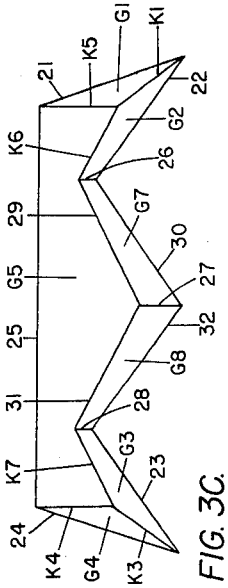

FIG. 1 illustrates the concave polygon F6 and its five equal sides 1,2,3,4 and 5 which comprise the back, or bottom surface F6 of polyhedron V FIGS. *2a–2c*, to which polyhedron shape closely conforms the shape of the simpler puzzle piece herein described. The divergent sides (2 and 3) of the polygon impose on diagonals D1 and D2 from opposite side 5. In FIG. *2c* the four surfaces F1, F2, F3 and F4 each hold 63 degree dihedral relationships with the surface F6 (FIG. *2b*) while at edge 5 the dihedral of surface F5 with F6 compares to about half the measure. Altogether this substantially locates the remaining surface adjacencies, or edges, J1,J2,J3,J4 and J5. For better ease of identification of that latter dihedral angle associated with edge 5 it may be referred to herein as simply "the fifth dihedral angle".

Polyhedron V is represented in polyhedron W of FIGS. *3a–3c* through corresponding surfaces G1,G2,G3,G4,G5 and G6 for which exists an equivalent set of dihedral angles as were described for polyhedron V. The surface adjacencies, or edges, 21,22,23,24,25,K1,K3,K4,K5,K6 and K7 of polyhedron W corrrespond respectively to adjacencies, or edges, 1,2,3,4,5,J1,J3,J4,J5,J6 and J7 of polyhedron V. Polyhedron W further includes seventh and eighth surfaces G7 and G8 between surfaces G3 and G2 to make respective pairs of parallel surfaces plus also new adjacencies or edges 26,27 and 28. The surfaces G5 and G6 of polyhedron W are, in comparison to their counterparts in polyhedron V, expanded uniformly lengthwise and extended widthwise to make agreeable edges 29,30,31 and 32 for the inclusion, or rather perhaps insertion, of those seventh and eighth surfaces G7 and G8 of polyhedron W. The two polyhedrons as such are then equivalent overlooking the described expansion, extension, and insertion upon the midsection of polyhedron W.

FIG. 4 is of a somewhat suggestive, tile-like design substantially duplicable using puzzle pieces of the shapes previously described, and is also substantially one of many different possible designs which might occur in the course of play activity with puzzle pieces of these types. The method involved here places the largest surface of each piece, corresponding to either surface F6 or G6 of previous illustration, upon a useable tabletop or the like. Substantial angular compatabilities of these surfaces and equivalent edge lengths allow them to closely interlay about one another for characteristically non-periodic and often highly differentiable geometric designs.

FIG. 5 illustrates a more or less integrated and coherent assemblage comprising a substantial denominator in an endless series of possible three-dimensional puzzles which could occur also out of play activity with the described puzzle pieces. Removed from combination to reveal its orientation is piece V.

Having thus described the invention, what I desire to claim and secure by Letters Patent are:

1. A puzzle piece, said piece having a shape comprising a polyhedron defined by a concave polygon and five other surfaces, said polygon having five equal sides, two of which said sides are imposed on the diagonals to the opposite side in the polygon, each of said other five surfaces bordering a different one of the said five sides and together making five dihedral angles with said polygon, four of which said dihedral angles measure about 63° each and the fifth angle about half that measure, said fifth dihedral angle located opposite of said imposed sides, said puzzle piece able to be combined with other pieces of the same configuration for the working of both tile-like puzzles or designs and three-dimensional puzzles.

2. A puzzle piece, said puzzles piece having a shape comprising a polyhedron defined by a seven-sided concave polygonal surface and seven other surfaces bordering said polygon, said polygonal surface having at least four equal edges, six of said other surfaces, including two pairs of parallel surfaces, forming dihedral angles of about 63° with said polygon, the seventh of said other surfaces forming a dihedral angle of about half the measure of the first six dihedral angles with respect to the side of said polygon which is opposed to the sides of said polygon from which said pairs of parallel surfaces extend, said puzzle piece able to be combined with other pieces of the same configuration, and also with puzzles pieces configurated as defined by claim 1, for the working of both tile-like puzzles or designs and three-dimensional puzzles.

* * * * *